US007528804B2

(12) United States Patent
Chung et al.

(10) Patent No.: US 7,528,804 B2
(45) Date of Patent: May 5, 2009

(54) METHOD AND APPARATUS FOR DRIVING PLASMA DISPLAY PANEL

(75) Inventors: Moon Shick Chung, Kumi-shi (KR); Jung Sub Shin, Kangwon-do (KR)

(73) Assignee: LG Electronics Inc., Seoul (KR)

( * ) Notice: Subject to any disclaimer, the term of this patent is extended or adjusted under 35 U.S.C. 154(b) by 852 days.

(21) Appl. No.: 10/869,842

(22) Filed: Jun. 18, 2004

(65) Prior Publication Data

US 2005/0001793 A1 Jan. 6, 2005

(30) Foreign Application Priority Data

Jun. 20, 2003 (KR) ..... 10-2003-0040117

(51) Int. Cl.
*G09G 3/28* (2006.01)
*G09G 3/10* (2006.01)

(52) U.S. Cl. ..... 345/63; 345/66; 345/68; 315/169.1; 315/169.2; 315/169.4

(58) Field of Classification Search ..... 345/60–63, 345/66–69; 315/169.1, 169.3, 169.4
See application file for complete search history.

(56) References Cited

U.S. PATENT DOCUMENTS

| | | | | |
|---|---|---|---|---|
| 5,990,854 | A | 11/1999 | Weber | 345/66 |
| 6,242,860 | B1 * | 6/2001 | Sasao et al. | 313/586 |
| 6,285,128 | B1 * | 9/2001 | Amemiya | 313/582 |
| 6,344,713 | B1 * | 2/2002 | Awaji et al. | 313/582 |
| 6,975,285 | B2 * | 12/2005 | Myung | 345/60 |
| 7,053,559 | B2 * | 5/2006 | Kim et al. | 315/169.3 |

FOREIGN PATENT DOCUMENTS

| | | |
|---|---|---|
| EP | 0 867 853 A2 | 9/1998 |
| JP | 04-009895 | 1/1992 |
| JP | 04-242285 | 8/1992 |
| JP | 05-323923 | 12/1993 |
| JP | 10-069858 | 3/1998 |
| JP | 11-085098 | 3/1999 |
| JP | 11-162356 | 6/1999 |
| JP | 11-296139 | 10/1999 |
| JP | 11-344936 | 12/1999 |
| JP | 2000-155556 | 6/2000 |

OTHER PUBLICATIONS

European Search Report dated Apr. 20, 2007.
Chinese Office Action dated Apr. 27, 2007.
Office Action issued by the Korean Patent Office (English translation not currently available).
European Search Report dated May 2, 2007.
Japanese Office Action dated Sep. 25, 2007.
Japanese Office Action dated Mar. 25, 2008.

* cited by examiner

*Primary Examiner*—Henry N Tran
(74) *Attorney, Agent, or Firm*—Ked & Associates LLP

(57) ABSTRACT

A method and apparatus of driving a plasma display panel for preventing a damage of a driving integrated circuit caused by an abnormal discharge generated from a non-display area is disclosed. In the apparatus, a plurality of drivers drives driving electrodes of an active area and dummy electrodes of a non-display area. A current limiter is positioned between any at least one of the dummy electrodes and the drivers to limit currents flowing in the dummy electrodes.

4 Claims, 14 Drawing Sheets

METHOD AND APPARATUS FOR DRIVING PLASMA DISPLAY PANEL

This application claims the benefit of Korean Patent Application No. P2003-40117 filed in Korea on Jun. 20, 2003, which is hereby incorporated by reference.

BACKGROUND OF THE INVENTION

1. Field of the Invention

This invention relates to a plasma display panel, and more particularly to a method and apparatus of driving a plasma display panel that is adaptive for preventing a damage of a driving integrated circuit caused by an abnormal discharge generated from a non-display area.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a sustain electrode pair having a scan electrode Y and a sustain electrode Z provided on an upper substrate 1, and an address electrode X provided on a lower substrate 2 in such a manner to perpendicularly cross the sustain electrode pair. Each of the scan electrode Y and the sustain electrode Z consists of a transparent electrode, and a metal bus electrode thereon. On the upper substrate 1 provided with the scan electrode Y and the sustain electrode, an upper dielectric layer 6 and a MgO protective layer 7 are disposed. A lower dielectric layer 4 is formed on the lower substrate 2 provided with the address electrode X in such a manner to cover the address electrode X. Barrier ribs 3 are vertically formed on the lower dielectric layer 4. A phosphorous material 5 is provided on the surfaces of the lower dielectric layer 4 and the barrier ribs 3. An inactive mixture gas such as He+Xe, Ne+Xe or He+Ne+Xe is injected into a discharge space among the upper substrate 1, the lower substrate 2 and the barrier ribs 3. The upper substrate 1 is joined with the lower substrate 2 with the aid of a sealant (not shown).

Such a PDP makes a time-divisional driving of one frame, which is divided into various sub-fields having a different emission frequency, so as to realize gray levels of a picture. Each sub-field is again divided into an initialization period (or reset period) for initializing the entire field, an address period for selecting the scan line and selecting the cell from the selected scan line and a sustain period for expressing gray levels depending on the discharge frequency. The initialization period is divided into a set-up interval supplied with a rising ramp waveform and a set-down interval supplied with a falling ramp waveform. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the conventional PDP shown in FIG. 1.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to all the scan electrodes Y in a set-up interval SU. A discharge is generated within the cells at the full field with the aid of the rising ramp waveform Ramp-up. By this set-up discharge, positive wall charges are accumulated onto the address electrode X and the sustain electrode Z while negative wall charges are accumulated onto the scan electrode Y. In a set-down interval SD, a falling ramp waveform Ramp-down falling from a positive voltage lower than a peak voltage of the rising ramp waveform Ramp-up is simultaneously applied to the scan electrodes Y after the rising ramp waveform Ramp-up was applied. The falling ramp waveform Ramp-down causes a weak erasure discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the sustain electrodes Z during the set-down interval and the address period. The direct current voltage Zdc establishes a voltage difference between the sustain electrode Z and the scan electrode Y or between the sustain electrode Z and the address electrode X such that a set-down discharge is generated between the sustain electrode Z and the scan electrode Y in the set-down interval and a discharge is not largely generated between the scan electrode Y and the sustain electrode Z in the address period.

In the sustain period, a sustaining pulse sus is alternately applied to scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied. Just after the sustain discharge was finished, a ramp waveform ramp-ers having a small pulse width and a low voltage level is applied to the sustain electrode Z to thereby erase wall charges left within the cells of the entire field.

Meanwhile, as shown in FIG. 4 and FIG. 5, the PDP includes a discharge space having the same structure as the discharge cell of the active area 31 at each of an upper non-display area 32 positioned at the upper outside of the active area 31 and a lower non-display area 33 positioned at the lower outside thereof. In other words, each of the upper non-display area 32 and the lower non-display area 33 is provided with an address electrode X, upper/lower Y dummy electrodes UY1, UY2, BY1 and BY2, and upper/lower Z dummy electrodes UZ1, UZ2, BZ1 and BZ2, and dielectric layers 4 and 6 are formed in such a manner to cover the electrodes X, UY1, UY2, BY1, BY2, UZ1, UZ2, BZ1 and BZ2.

The dummy electrodes UDE and BDE provided at each of the upper non-display area 32 and the lower non-display area 33 cause a discharge at the non-display area upon aging process, to thereby stabilize discharge characteristics of discharge cells on the first horizontal line and the nth horizontal line of the active area 31 at the same condition as other discharge cells at the active area 31. To this end, a voltage capable of causing a discharge upon aging process is applied to the dummy electrodes UDE and BDE while a voltage is not applied thereto after the aging process.

However, the conventional PDP has a problem in that a discharge is accidentally generated from the upper non-display area 32 and the lower non-display area 33. Such a discharge is referred to as "abnormal discharge". More specifically, if a discharge such as an initialization discharge, an address discharge and a sustain discharge, etc. occurs upon driving of the PDP, then space charges generated by the discharge are accumulated onto dielectric layers of the upper non-display area 32 and the lower non-display area 33. For instance, upon address discharge, while a negative scan pulse scan being sequentially shifted into the scan electrodes Y1 to Yn as shown in FIG. 5, positive space charges 53 are moved into the lower non-display area 33 and, at the same time, negative space charges 51 are moved into the upper non-display area 32. The space charges 51 and 53 moved into the non-display areas 32 and 33 in this manner are accumulated within the non-display areas 32 and 33, or onto the dielectric layers 4 and 6 having covered electrodes at the active area adjacent to the non-display areas 32 and 33. If a wall charge 61 of the discharge space rising by wall charges accumulated on the non-display areas 32 and 33 and the active area 31 adjacent thereto becomes more than a voltage enough to cause a discharge as shown in FIG. 6, then an abnormal discharge accidentally occurs within the non-display areas 32 and 33 and the active area 31 adjacent thereto.

Due to this abnormal discharge, a visible light 48 generated from the non-display areas 32 and 33 or the upper/lower edges of the active area 31 adjacent thereto is viewed by an observer as shown in FIG. 7. In the worse case, the PDP cannot display a picture during several seconds and its discharge cells may be damaged due to the abnormal discharge.

In order to solve such a problem, the upper/lower dummy Y electrodes UY1, UY2, BY1 and BY2 shown in FIG. 8 are kept at a floating state while the upper/lower dummy Z electrodes UZ1, UZ2, BZ1 and BZ2 are supplied with a predetermined driving voltage via the voltage supplier 40. Accordingly, wall charges within the non-display areas 32 and 33 can be reduced. Further, a movement of the wall charges can be restrained to prevent an abnormal discharge within the non-display areas 32 and 33.

However, since the upper/lower dummy Y electrodes UY1, UY2, BY1 and BY2 have been kept at a floating state, a locally serious accumulation of wall charges are generated. When the wall charges are enlarged in such a manner to be leaded to an abnormal discharge type, integrated circuits (IC's) around the wall charges causes defects identical to a case where a driving waveform is applied thereto.

In order to overcome this problem, as shown in FIG. 9, a second driving voltage, for example, a driving voltage supplied to the Y electrode of the active area during the initialization period is applied, via a second voltage supplier 42 to the upper/lower dummy Y electrodes UY1, UY2, BY1 and BY2 while a first driving voltage, for example, a driving voltage supplied to the Z electrode of the active area during the initialization period is applied, via a first voltage supplier 40 to the upper/lower dummy Z electrodes UZ1, UZ2, BZ1 and BZ2. Accordingly, wall charges within the non-display areas 32 and 33 can be reduced. Further, a movement of the wall charges can be restrained to prevent an abnormal discharge within the non-display areas 32 and 33.

However, the PDP having the upper/lower dummy Y electrodes UY1, UY2, BY1 and BY2 connected to the second voltage supplier 42 as shown in FIG. 9 has a problem in that an abnormal current, for example, a current of about 700 mA is applied from the second voltage supplier 42 to the dummy Y electrodes UY1, UY2, BY1 and BY2 to thereby cause an abnormal discharge, and this discharge current is reversely flown into the data driving IC and the scan driving IC having a chip on film (COF) type to thereby damage the driving IC's.

SUMMARY OF THE INVENTION

Accordingly, it is an object of the present invention to provide a method and apparatus of driving a plasma display panel that is adaptive for preventing a damage of a driving integrated circuit caused by an abnormal discharge generated from a non-display area.

In order to achieve these and other objects of the invention, a driving apparatus for a plasma display panel, having an active area for displaying a picture and a non-display area being adjacent thereto at the upper and lower sides of the active area, according to one aspect of the present invention includes a plurality of drivers for driving driving electrodes of said active area and dummy electrodes of said non-display area; and current limiting means positioned between any at least one of the dummy electrodes and the drivers to limit currents flowing in the dummy electrodes.

In the driving apparatus, the current limiting means is any one of a resistor and a coil.

The current limiting means has a resistance value of about 10Ω to 10 kΩ.

Any at least one of the driving electrodes of said active area and any at least one of the dummy electrodes of said non-display area are supplied with the same signal.

The driver includes a scan driver for applying a first driving signal to any at least one of the scan electrodes of said active area and the dummy electrodes of said non-display area.

The driver includes an address driver for applying a second driving signal to address electrodes of said active area.

The driver includes a sustain driver for applying a third driving signal to any at least one of the sustain electrodes of said active area and the dummy electrodes of said non-display area.

A driving apparatus for a plasma display panel, having an active area for displaying a picture and a non-display area being adjacent thereto at the upper and lower sides of the active area, according to another aspect of the present invention includes a plurality of drivers for driving driving electrodes of said active area and dummy electrodes of said non-display area; and excessive current eliminating means positioned between any at least one of the dummy electrodes and the drivers to detect excessive currents flowing in the dummy electrodes and bypass the detected excessive currents.

In the driving apparatus, the excessive current eliminating means includes a current detector for generating a current control signal when a current value flowing in the dummy electrodes is more than a critical value; and switching means for bypassing said excessive current into a low voltage in response to said current control signal.

A method of driving a plasma display panel, having an active area for displaying a picture and a non-display area being adjacent thereto at the upper and lower sides of the active area, according to still another aspect of the present invention includes the step of limiting a current flowing in any at least one of dummy electrodes positioned within said non-display area.

In the method, any at least one of the driving electrodes of said active area and any at least one of the dummy electrodes positioned within said non-display area are supplied with the same signal.

Said at least one of dummy electrodes and scan electrodes of said active area are supplied with an initialization waveform during an initialization period for initializing cells of said active area and with a direct current voltage during an address period for selecting the cells.

Address electrodes of said active area are supplied with a data pulse during said address period.

Sustain electrodes of said active area and said at least one of dummy electrodes are supplied with said direct current voltage during at least portion of said initialization period and said address period.

A method of driving a plasma display panel, having an active area for displaying a picture and a non-display area being adjacent thereto at the upper and lower sides of the active area, according to still another aspect of the present invention includes the steps of detecting excessive currents flowing in dummy electrodes of said non-display area; and bypassing said detected excessive currents into a ground voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
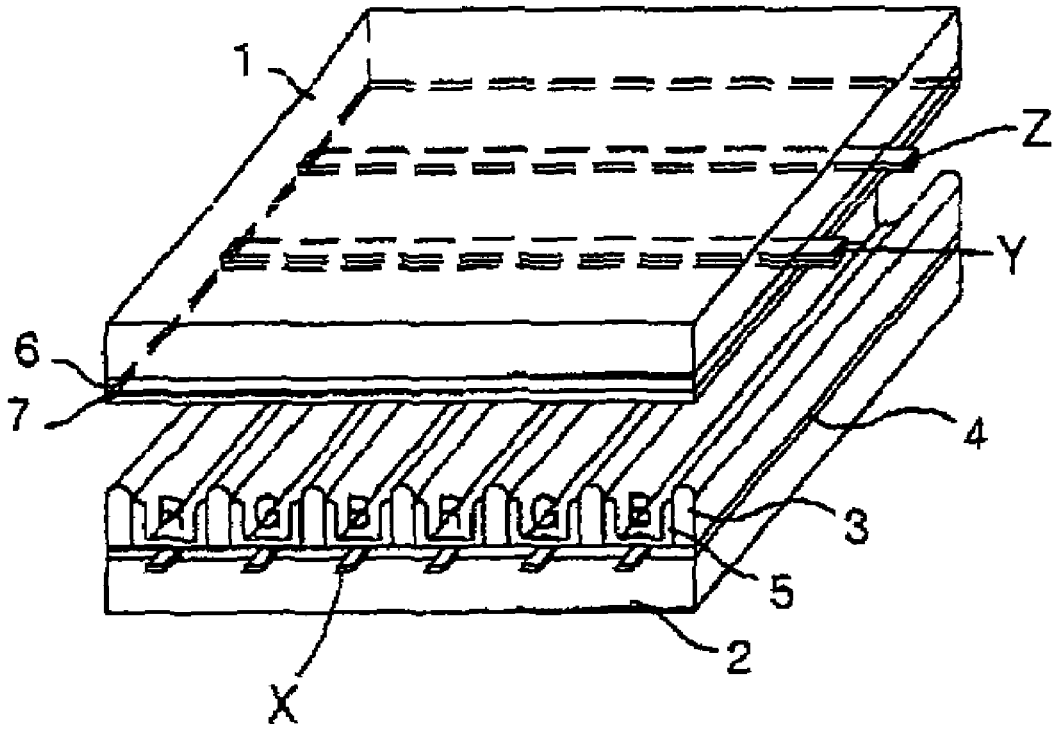
FIG. 1 RELATED ART
FIG. 1 is a perspective view showing a discharge cell structure of a conventional three-electrode, AC surface-discharge plasma display panel.
Figure 2:
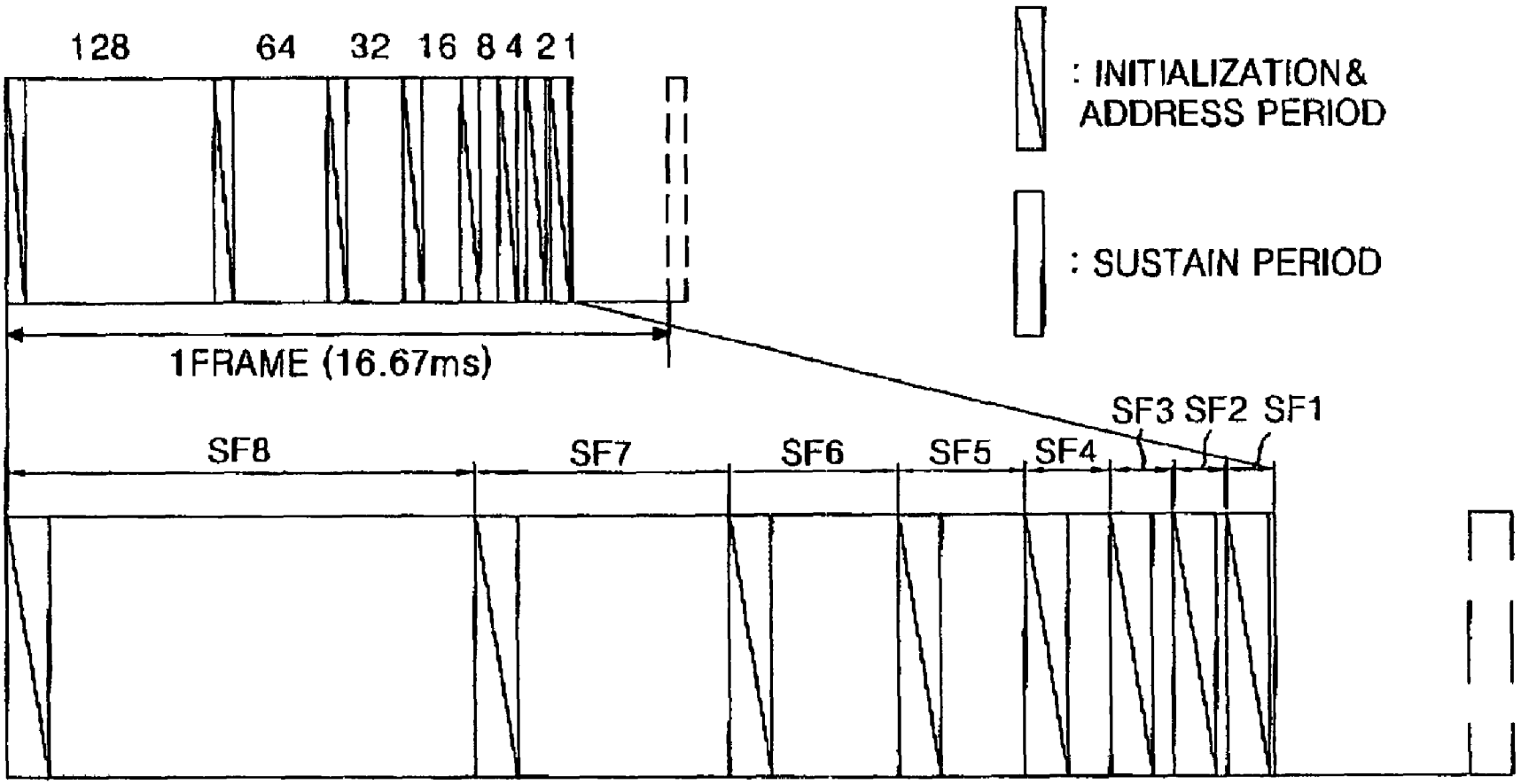
FIG.2 RELATED ART
FIG. 2 illustrates a frame configuration having 8-bit default codes for implementing 256 gray levels.
Figure 3:
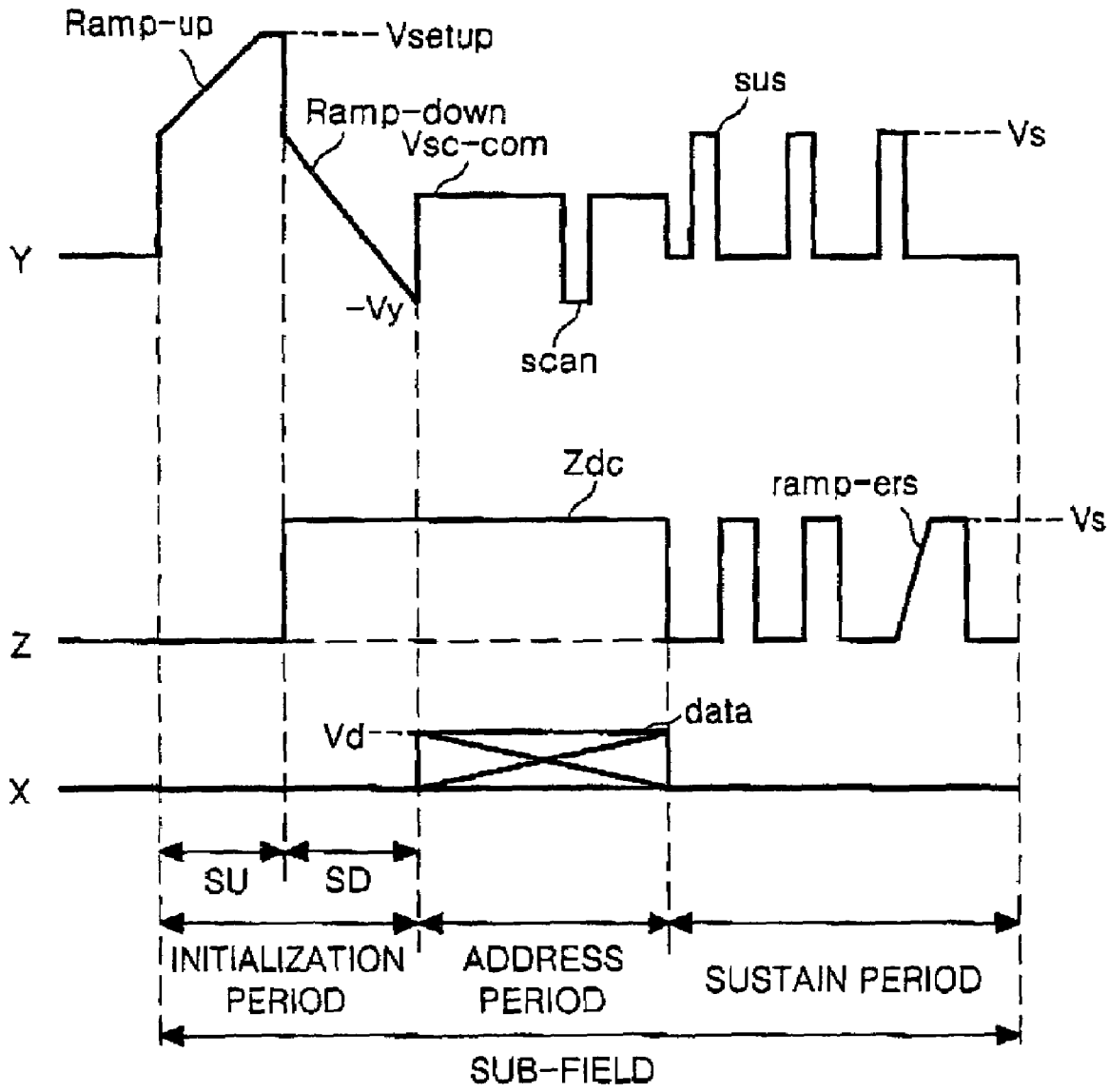
FIG. 3 RELATED ART
FIG. 3 is a waveform diagram of driving signals for driving the conventional plasma display panel.
Figure 4:
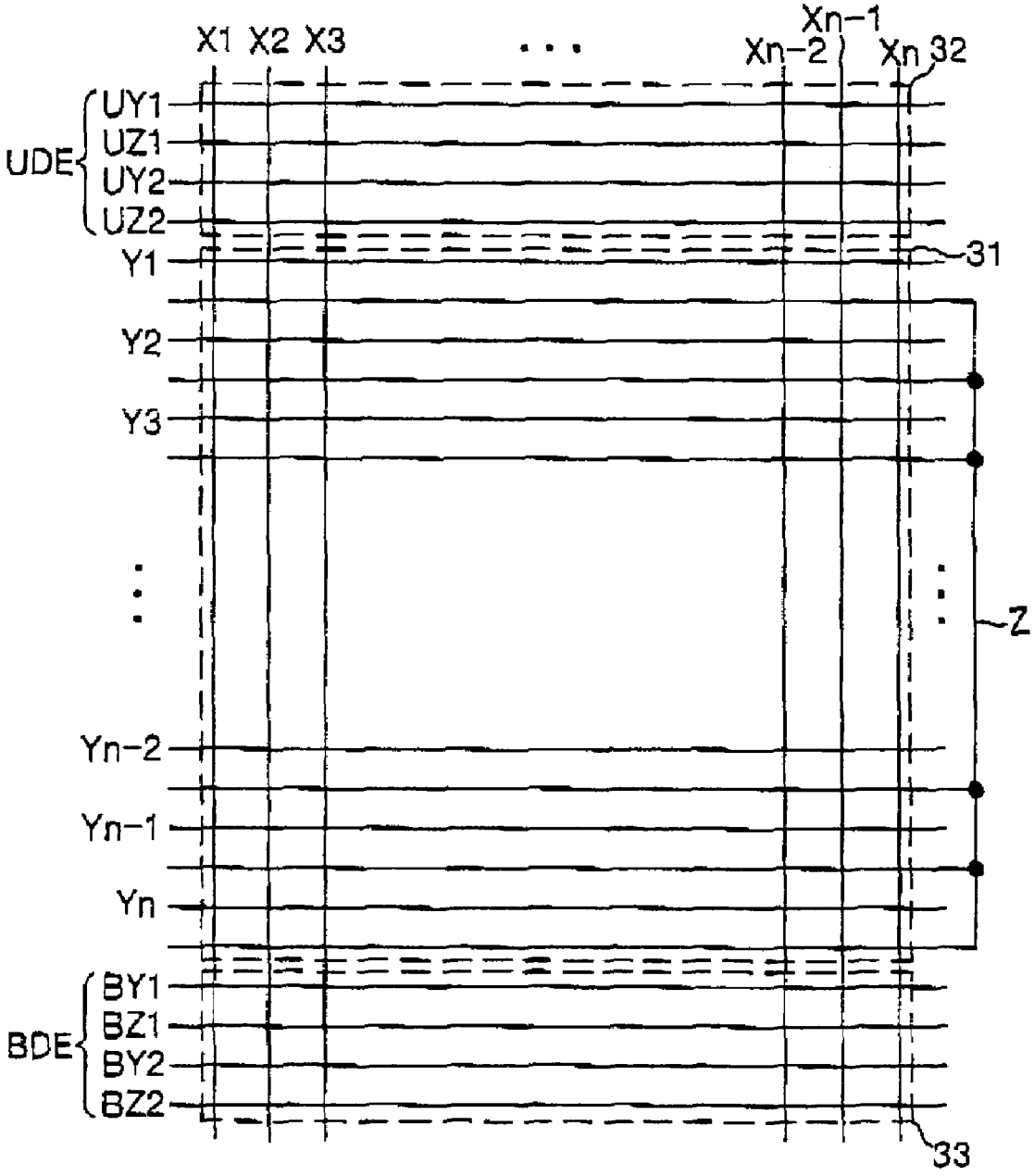
FIG. 4 RELATED ART
FIG. 4 is a plan view of the plasma display panel for representing a non-display area.
Figure 5:
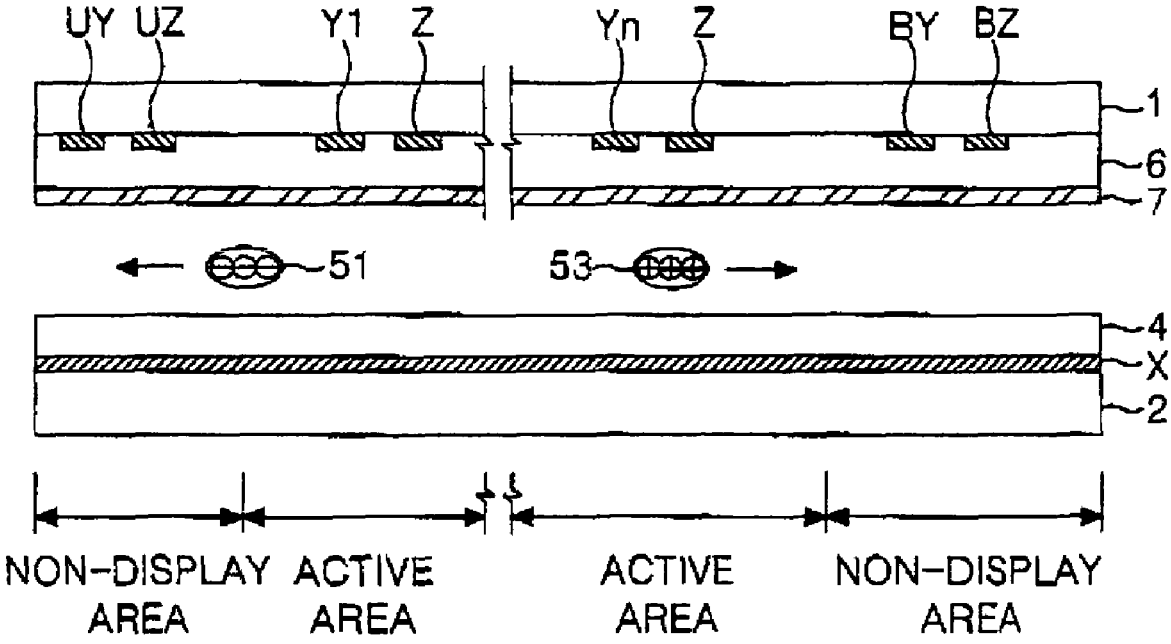
FIG. 5 RELATED ART
FIG. 5 is a section view of the plasma display panel for representing a non-display area.
Figure 6:
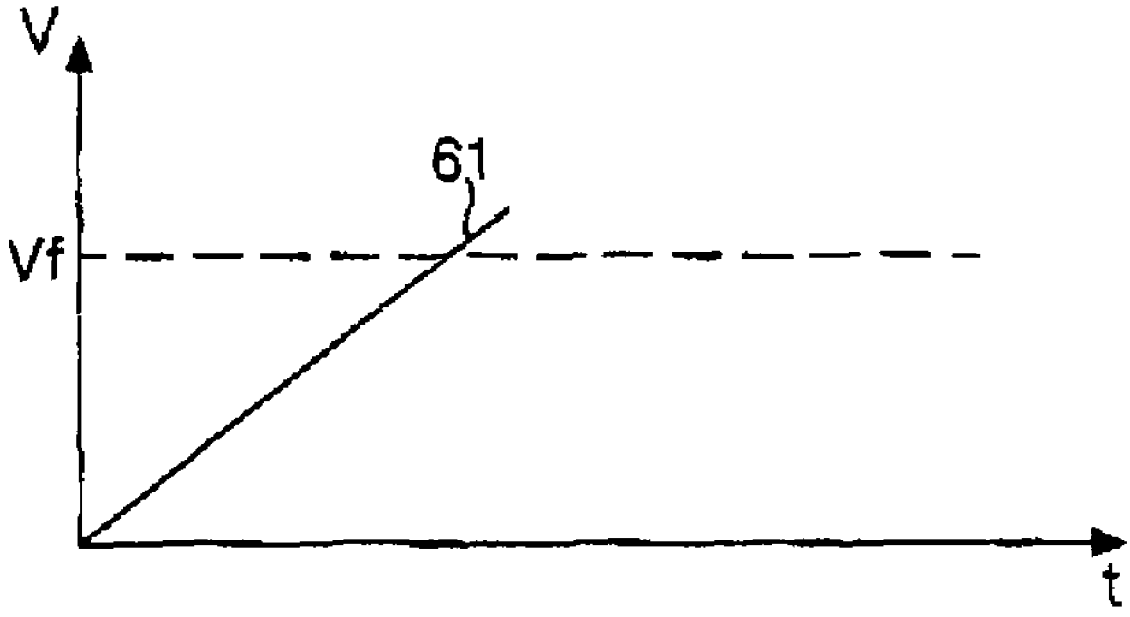
FIG. 6 RELATED ART
FIG. 6 is a graph representing a wall charge rising continuously at the non-display area.
Figure 7:
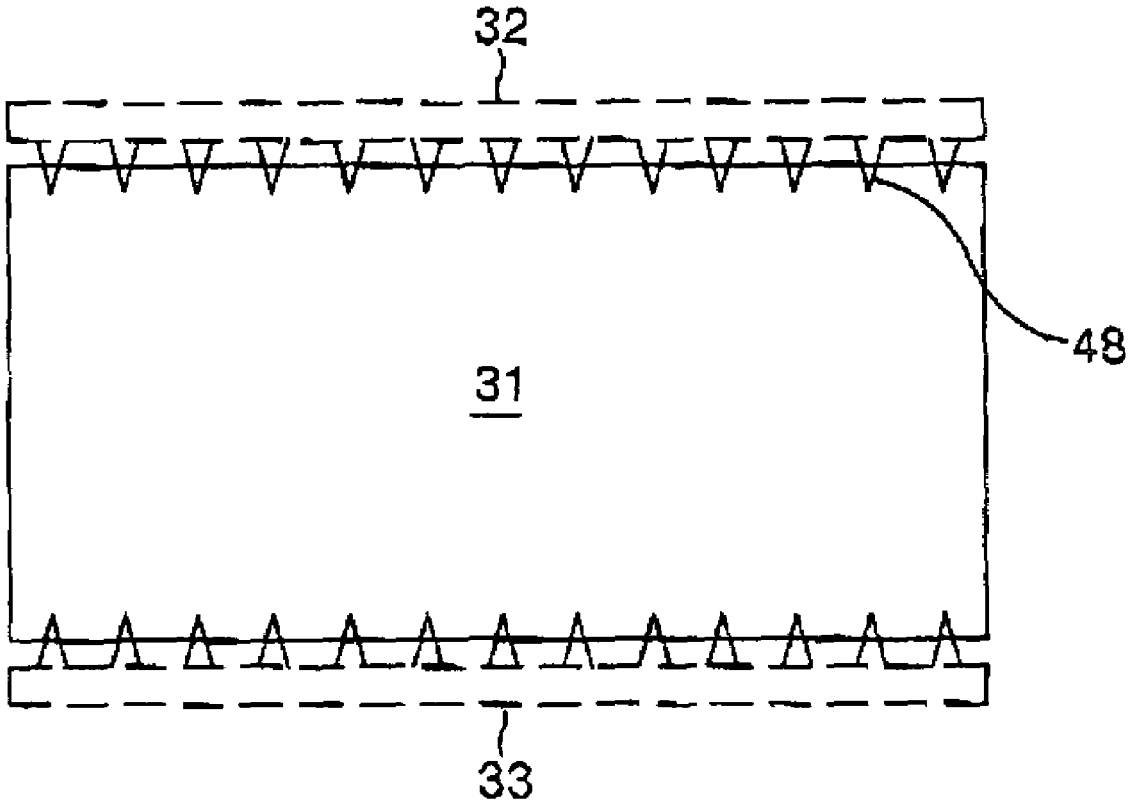
FIG. 7 RELATED ART
FIG. 7 schematically depicts a visible light generated from the non-display area and recognized at the active area.
Figure 8:
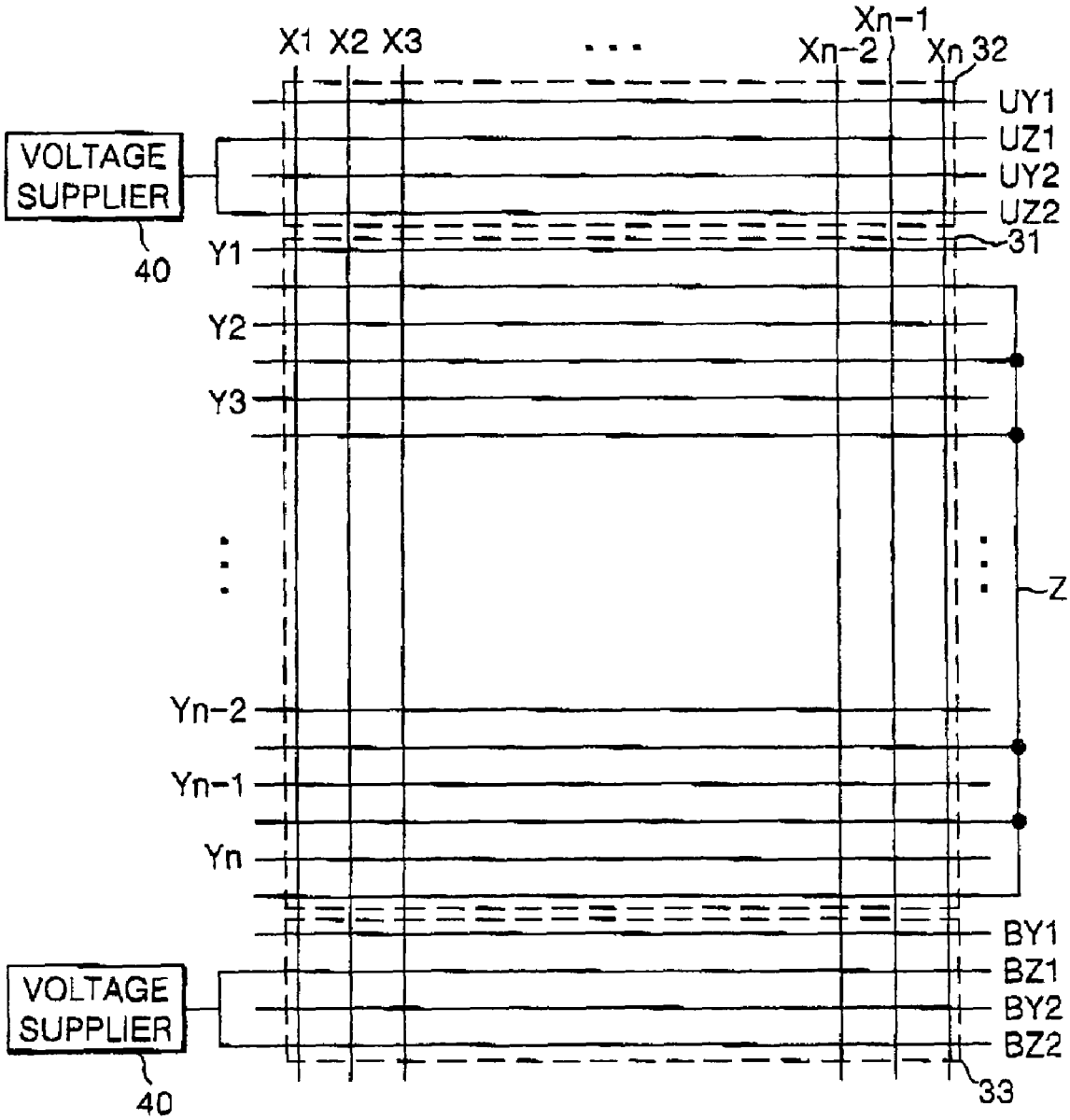
FIG.8 RELATED ART
FIG. 8 is a plan view of the conventional plasma display panel in which a driving voltage is applied to the dummy electrodes for preventing an abnormal discharge.
Figure 9:
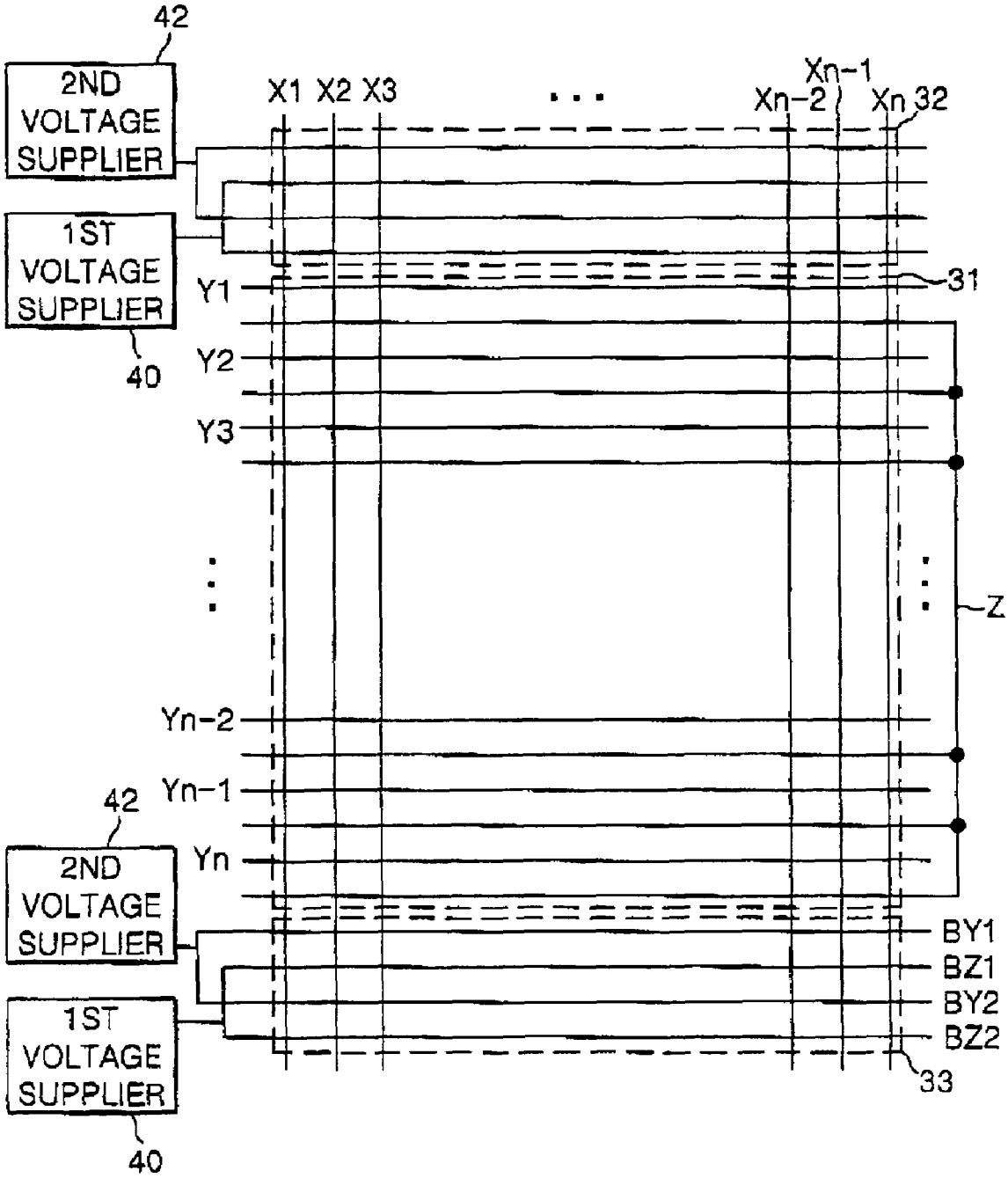
FIG. 9 RELATED ART
FIG. 9 is a plan view of the conventional plasma display panel in which a different driving voltage is applied to the dummy Y electrodes and the dummy Z electrodes for preventing an abnormal discharge.
Figure 10:
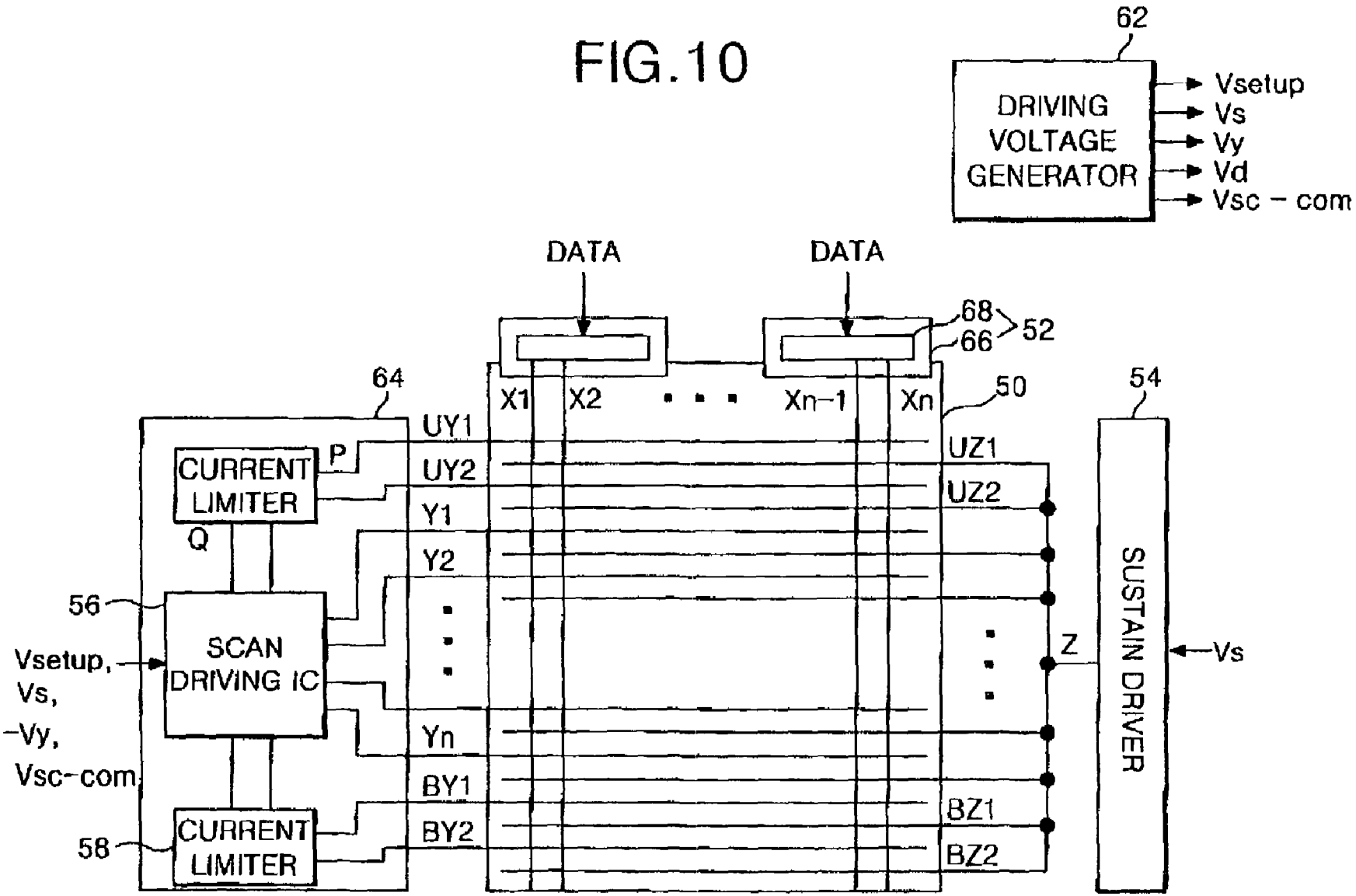
FIG. 10 is a schematic block diagram showing a configuration of a driving apparatus for a plasma display panel according to a first embodiment of the present invention.

FIG. 10 shows a driving apparatus for a plasma display panel (PDP) according to a first embodiment of the present invention.

Referring to FIG. 10, the driving apparatus includes a PDP 50 divided into a non-display area at which a plurality of dummy electrodes are positioned and an active area at which a picture is displayed, an address driver 52 for supplying a data to address electrodes X of the PDP 50, a scan driver 64 for driving scan electrodes Y of the PDP 50, a sustain driver 54 for driving sustain electrodes Z of the PDP 50, a driving voltage generator 62 for generating a driving voltage, and a current limiter 58 for limiting currents of voltages supplied to dummy electrodes UY, BY, UZ and BZ.

The PDP 50 includes scan electrodes Y, sustain electrodes Z and upper/lower dummy electrodes UY1, UY2, UZ1, UZ2, BY1, BY2, BZ1 and BZ2 that are provided on an upper substrate, and address electrodes X provided on a lower substrate.

Figure 11:
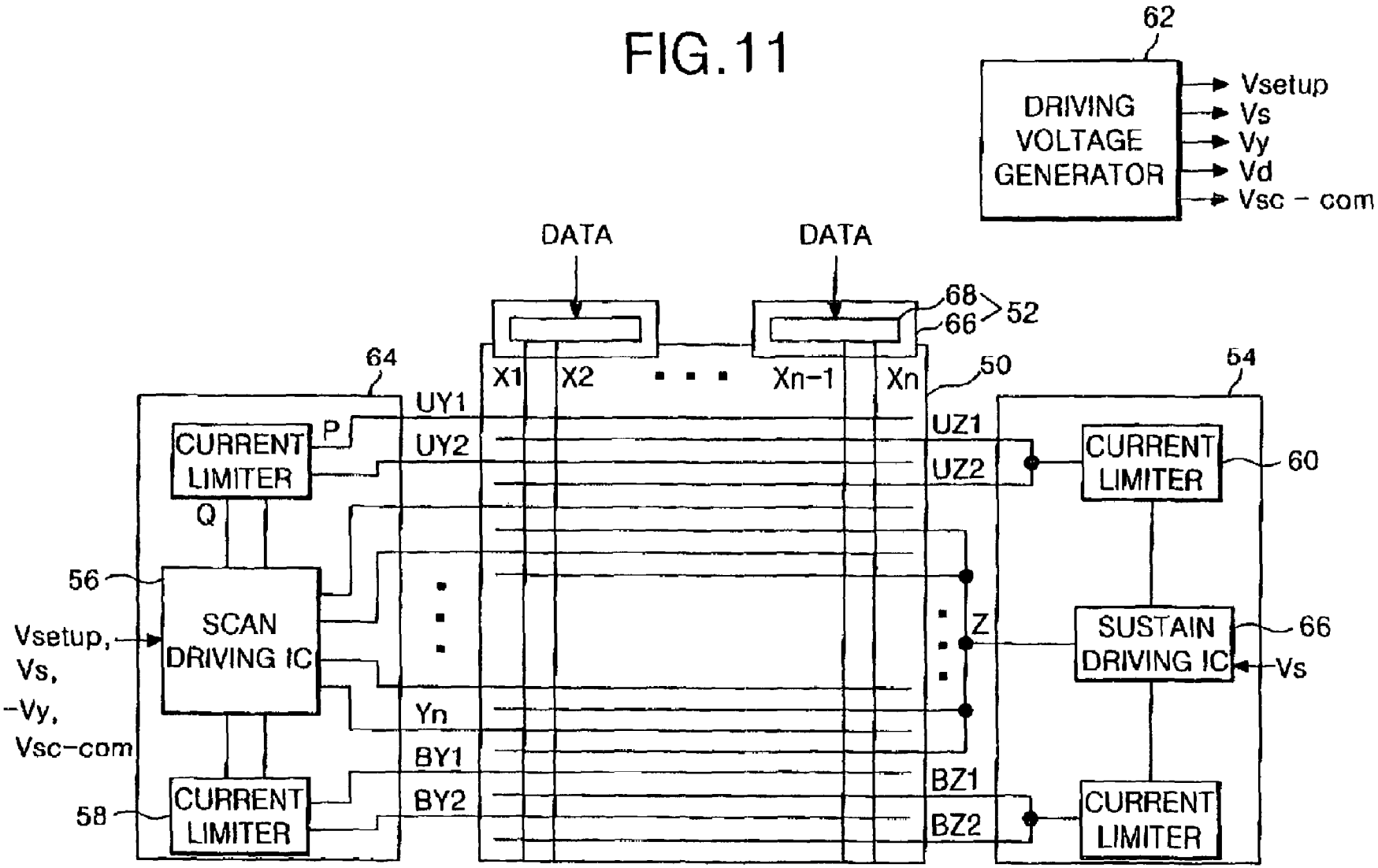
FIG. 11 is a block diagram of the sustain driver having the current limiter shown in FIG. 10.

The scan electrodes Y and the sustain electrodes Z are provided on the upper substrate of the PDP 50 within the display area. The dummy electrodes UY1, UY2, UZ1, UZ2, BY1, BY2, BZ1 and BZ2 are provided on the upper substrate of the PDP 50 within non-display areas positioned at the upper and lower sides of the display area. The address electrodes X are provided on the lower substrate of the PDP 50 in such a manner to cross the scan electrodes Y, the sustain electrodes Z and the dummy electrodes UY1, UY2, UZ1, UZ2, BY1, BY2, BZ1 and BZ2. Upper/lower dummy Y electrodes UY1, UY2, BY1 and BY2 of the dummy electrodes are supplied with a driving voltage having a current limited by the current limiter 58. On the other hand, upper/lower dummy Z electrodes UZ1, UZ2, BZ1 and BZ2 may be supplied with a driving voltage generated from a sustain driving IC 66 and having a current limited by a current limiter 60 as shown in FIG. 11.

The address driver 52 is subject to an inverse gamma correction and an error diffusion by means of an inverse gamma correction circuit and an error diffusion circuit, etc. (not shown), and thereafter simultaneously supplies a data mapped for each sub-field by a sub-field mapping circuit to the address electrodes X.

The scan driver 64 simultaneously applies a rising ramp waveform rising until a set-up voltage Vsetup and a falling ramp waveform falling until 0V or a negative scan voltage −Vy during the reset period to both the scan electrodes Y1 to Yn and the dummy Y electrodes UY1, UY2, BY1 and BY2 under control of a timing controller (not shown), to thereby initialize the entire field. Further, the scan driver 64 sequentially applies a scanning pulse falling from a scan common voltage Vsc-com until a negative scan voltage −Vy during the address period to the scan electrodes Y1 to Yn to thereby select a scan line. The scan driver 64 applies a direct current bias voltage keeping 0 volt or a specific positive voltage level, for example, a scan common voltage Vsc-com to the dummy Y electrodes UY1, UY2, BY1 and BY2 to confine negative wall charges at the dummy Y electrodes UY1, UY2, BY1 and BY2, thereby restraining an abnormal discharge from being generated between the active area and the non-display area. During the sustain period following the address period, the scan driver 64 simultaneously applies a sustaining pulse having a sustain voltage level Vs to the scan electrodes Y1 to Ym and the dummy Y electrodes UY1, UY2, BY1 and BY2 by a frequency corresponding to a brightness weighting value.

The sustain driver 54 applies a direct current (DC) voltage Zdc always maintaining the sustain voltage Vs during the set-down interval SD of the initialization period and the address period to the sustain electrodes Z and the dummy Z electrodes UZ1, UZ2, BZ1 and BZ2 under control of the timing controller. Further, during the sustain period, the sustain driver 54 is operated alternately with the scan driver 64 to apply a sustaining pulse to the sustain electrodes Z and the dummy Z electrodes UZ1, UZ2, BZ1 and BZ2.

The current limiter 58 is generated from the scan driving IC 56 to limit currents of driving voltages supplied to the upper/lower dummy Y electrodes UY1, UY2, BY1 and BY2. Further, the current limiter 58 limits a current reversely applied, via the upper/lower dummy Y electrodes UY1, UY2, BY1 and BY2, to the scan driving IC 56.

To this end, the current limiter 58 is configured by a resistor or a coil having a predetermined resistance value (e.g., 10Ω to 10 kΩ). The current limiter 58 is connected, in series, to an input terminal of the upper/lower dummy Y electrodes UY1, UY2, BY1 and BY2, that is, to the upper/lower dummy Y electrodes UY1, UY2, BY1 and BY2. Further, the current limiter 58 is connected, in series, to an output terminal of the scan driving IC 56 of the scan driver 64, or is formed in such a manner to be built in the scan driving IC 56.

Such a current limiter 58 allows normal driving voltages having a limited current to be supplied to the upper/lower dummy Y electrodes UY1, UY2, BY1 and BY2, and permits to prevent an excessive current from being inputted, via the upper/lower dummy Y electrodes UY1, UY2, BY1 and BY2, to the scan driving IC 56 or the data driving IC 68.

Figure 12:
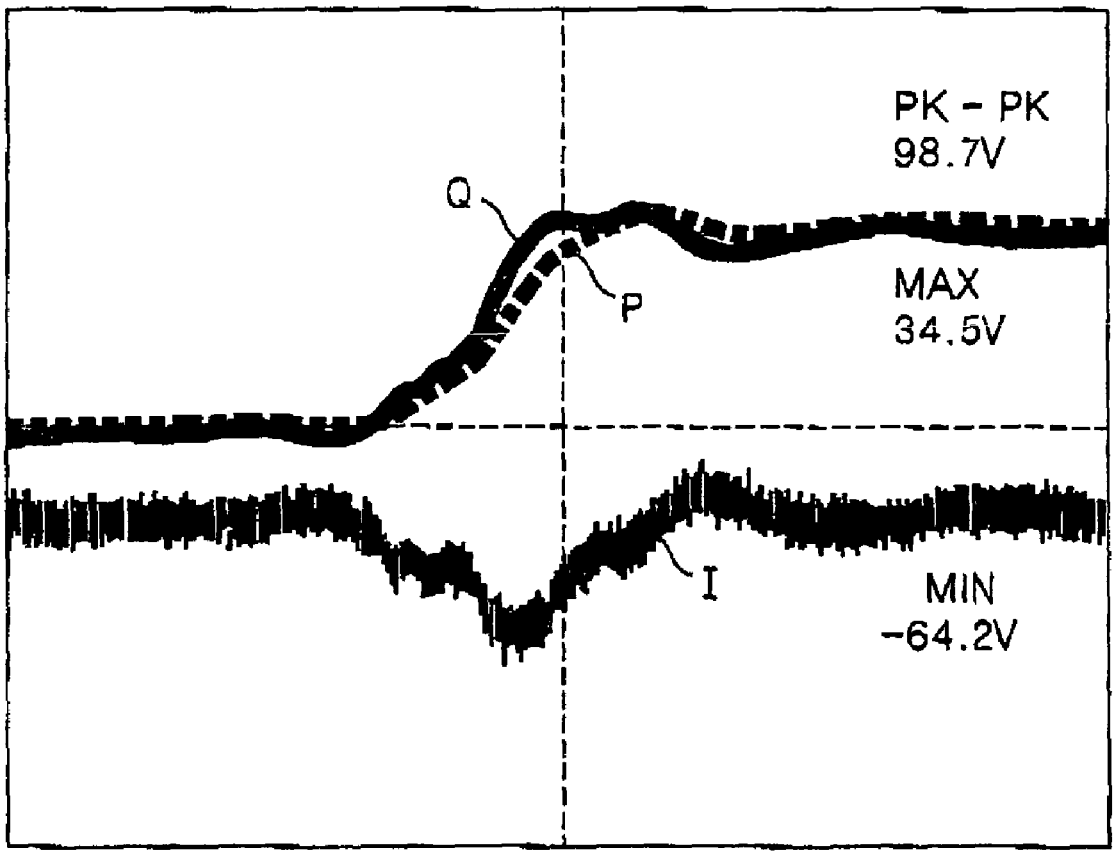
FIG. 12 is a waveform diagram representing a relationship of a voltage to a current caused by the current limiter shown in FIG. 10 and FIG. 11.

More specifically, voltages P and Q at each terminal of the current limiting device are equal to each other as shown in FIG. 12. Thus, a voltage value Q generated from the scan driving IC 56 is equal to a voltage value P applied from the scan driving IC 56, via the current limiting device 58, to the upper/lower dummy Y electrodes UY and BY. On the other hand, a current I applied to the upper/lower dummy Y electrodes UY and BY is reduced from 700 mA in the prior art into at most 29 mA by the current limiting device 58. Further, the current limiting device 58 reduces a relatively large value of excessive current inputted, via the upper/lower dummy Y electrodes UY and BY, to the scan driving IC 56 or the data driving IC 68. Accordingly, it becomes possible to prevent a damage of driving IC's including the data driving IC 68, the scan driving IC 56 and the sustain driving IC 66.

The driving voltage generator 62 generates voltages required for an electrode driving of the PDP 50 such as a set-up voltage Vsetup, a sustain voltage Vs, a negative scan voltage −Vy, a data voltage Vd and a scan common voltage Vsc-com, etc., and applies the driving voltages to the corresponding electrode drivers 52, 54 and 60.

Figure 13:
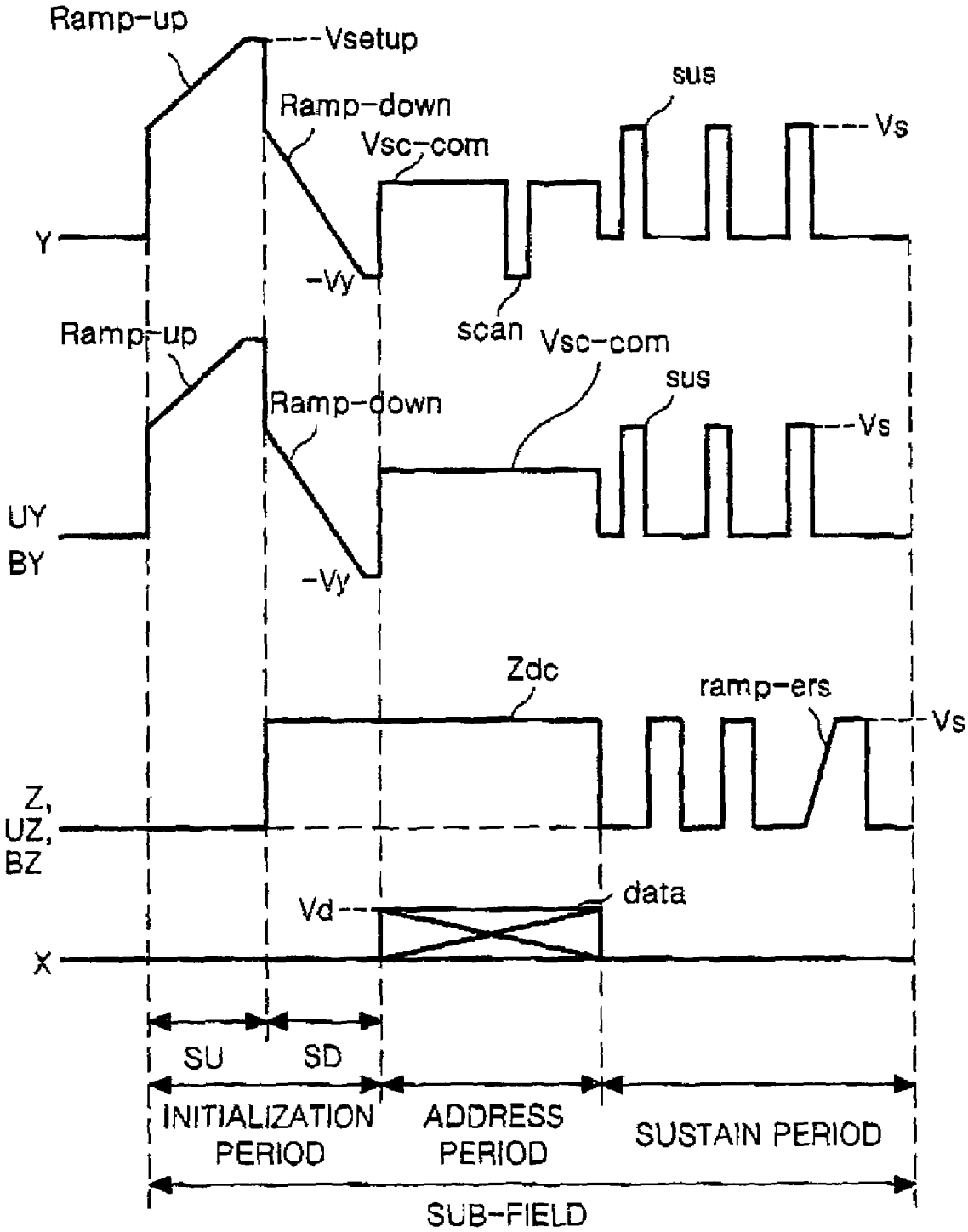
FIG. 13 is a waveform diagram of driving signals for driving the plasma display panel shown in FIG. 10.

FIG. 13 shows a driving waveform of the PDP shown in FIG. 10.

Referring to FIG. 13, a rising ramp waveform Ramp-up is simultaneously applied to all the scan electrodes Y and the dummy Y electrodes UY and BY in the set-up interval SU of the initialization period. A discharge is generated within the cells of the full field by this rising ramp waveform Ramp-up. After the rising ramp waveform Ramp-up was applied, a falling ramp waveform falling from a positive voltage lower than a peak voltage of the rising ramp waveform Ramp-up is simultaneously applied to the scan electrodes Y and the dummy Y electrodes UY and BY in the set-down interval SD of the initialization period. At this time, excessive currents included in voltages of the rising ramp waveform and the falling ramp waveform applied to the dummy Y electrodes are limited by the current limiting device. Thus, a majority of excessive wall charges left within the non-display area are erased by an initializing waveform applied to the dummy Y electrodes UY and BY, and such a state is maintained until termination of the address period by a DC bias voltage supplied in the address period. On the other hand, the scan electrodes Y1 to Yn of the active area rise until a positive scan common voltage Vsc-com upon initiation of the address period. Since voltages on the scan electrodes Y1 and Yn rise until the scan common voltage Vsc-com in this manner, the cells at the active area establish an address initialization condition in which wall charges enough to cause an address discharge are accumulated when a scanning pulse and a data pulse are applied at an address initiation time.

In the address period, a negative scanning pulse scan is sequentially applied to the scan electrodes Y and, at the same time, a positive data pulse data is applied to the address electrodes X in synchronization with the scanning pulse scan. While a voltage difference between the scanning pulse scan and the data pulse data being added to a wall voltage generated in the initialization period, an address discharge is generated within the cell supplied with the data pulse data. Within the cells selected by the address discharge, wall charges enough to cause a discharge upon application of the sustain voltage are formed. During such an address period, a DC bias voltage Vbias maintaining 0V or a positive voltage level is applied to the dummy Y electrodes UY and BY. The DC bias voltage Vbias applied to the dummy Y electrodes UY1, UY2, BY1 and BY2 binds negative space charges and negative wall charges within the non-display area onto the dummy Y electrodes UY1, UY2, BY1 and BY2.

The dummy Z electrodes UZ and BZ and the sustain electrodes Z maintains a positive voltage during the set-down interval SD of the initialization period and the address period. The positive DC voltages applied to the dummy Z electrodes UZ and BZ bind negative space charges and negative wall charges within the non-display area onto the dummy Z electrodes UZ and BZ during the set-down interval and the address period. The DC voltage Zdc supplied to the sustain electrodes Z establishes a voltage difference between the sustain electrode Z and the scan electrode Y or between the sustain electrode Z and the address electrode X such that a set-down discharge is caused between the sustain electrodes Z and the scan electrodes Y1 to Yn in the set-down interval and a discharge is not caused largely between the scan electrodes Y1 to Yn and the sustain electrode Z in the address period.

In the sustain period, a sustaining pulse sus is alternately applied to the scan electrodes Y1 to Yn and the sustain electrodes Z. At this time, the dummy Y electrodes UY and BY are supplied with a sustain voltage in similarity to the scan electrodes Y1 to Yn while the dummy Z electrodes UZ and BZ are supplied with a sustain voltage in similarity to the sustain electrodes Z, but an abnormal discharge is not generated within the non-display area even upon application of the sustain voltage because a wall voltage within the non-display area is very low. Within the active area, the cell selected by the address discharge causes a sustain discharge, that is, a display discharge whenever the sustain pulse sus is applied while a wall voltage within the cell being added to the sustaining pulse sus.

Just after the sustain discharge was finished, an erasing ramp waveform ramp-ers is applied to the sustain electrodes Z and the dummy Z electrodes UZ and BZ. With the aid of the erasing ramp waveform ramp-ers, wall charges left within the active area and the non-display area are erased.

Figure 14:
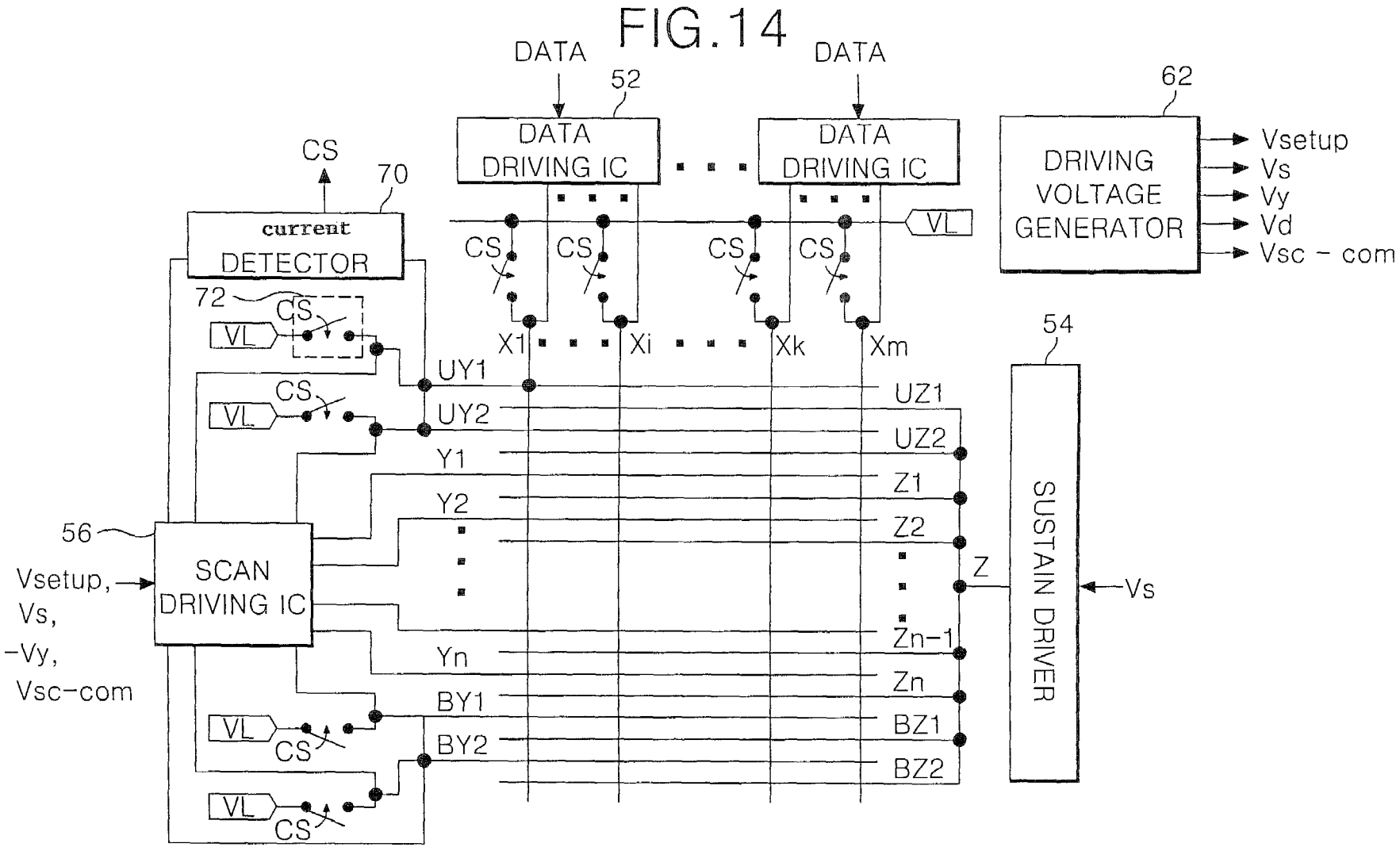
FIG. 14 is a schematic block diagram showing a configuration of a driving apparatus for a plasma display panel according to a second embodiment of the present invention.

FIG. 14 shows a driving apparatus for a PDP according to a second embodiment of the present invention.

Referring to FIG. 14, the driving apparatus has the same elements as the driving apparatus for the PDP shown in FIG. 10 except that it includes a current detector 70 for detecting a current flowing in the dummy electrode and switching means 72 operated in response to a current value detected by the current detector 70. Thus, a detailed explanation as to the same elements will be omitted.

The current detector 70 detects currents of driving signals flowing into the upper/lower Y dummy electrodes UY1, UY2, BY1 and BY2. In other words, the current detector 70 detects currents of driving signals generated from a scan driving IC 56 and flowing into the upper/lower Y dummy electrodes UY1, UY2, BY1 and BY2, and detects an abnormal discharge current reversely flowing into the scan driving IC 56 or the data driving IC 68 due to an abnormal discharge. When the detected current value is more than a critical value, the current detector 70 applies a current limiting signal CS to the switching means 72.

Switches of the switching means 72 are turned on in response to the current limiting signal CS to thereby bypass an excessive current via a low voltage VL, for example, a ground voltage.

Accordingly, normal driving signals can be applied to the upper/lower dummy electrodes UY1, UY2, BY1 and BY2, and an input of excessive currents, via the upper/lower dummy electrodes UY1, UY2, BY1 and BY2, to the scan driving IC 56 or the data driving IC 68 can be prevented.

As described above, according to the present invention, currents flowing into any at least one of the dummy Y electrodes and the dummy Z electrodes are limited. Accordingly, excessive currents does not flow in any at least one of the dummy Y electrodes and the dummy Z electrodes to generate a stable initialization discharge, so that it becomes possible to prevent a locally excessive accumulation of electric charges and thus prevent an abnormal discharge. Furthermore, a reverse input of abnormal excessive currents to the driving IC's can be prevented, so that it becomes possible to prevent a damage of the driving IC's.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel having an active area for displaying a picture and a non-display area being adjacent to at least one of upper or lower sides of the active area, said apparatus comprising:

at least one driver for driving electrodes of said active area and dummy electrodes of said non-display area; and an excessive current eliminating circuit, positioned between at least one of the dummy electrodes and the at least one driver, to detect whether a driving signal flowing to the at least one dummy electrode has an excessive current and to bypass the driving signal when an excessive current is detected.

2. The driving apparatus as claimed in claim 1, wherein the excessive current eliminating circuit includes:

a current detector for generating a current control signal when a current value of the driving signal flowing to the at least one dummy electrode is more than a critical value; and a switching circuit for bypassing the driving signal to couple the at least one dummy electrode to a predetermined voltage in response to said current control signal.

3. A method of driving a plasma display panel having an active area for displaying a picture and a non-display area being adjacent to at least one of upper or lower sides of the active area, said method comprising:

detecting an excessive current of a driving signal flowing to at least one dummy electrode of said non-display area; and bypassing the driving signal and coupling the at least one dummy electrode to a predetermined voltage when said excessive current is detected.

4. The method as claimed in claim 3, wherein the predetermined voltage corresponds to substantially a ground voltage.

* * * * *